US006781491B2

(12) United States Patent
Whipple et al.

(10) Patent No.: US 6,781,491 B2
(45) Date of Patent: Aug. 24, 2004

(54) QUICK CONNECT TERMINAL FOR ELECTRIC POWER SWITCH

(75) Inventors: Michael Jerome Whipple, Rochester, PA (US); Edward Ethber Lias, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 146 days.

(21) Appl. No.: 10/000,538

(22) Filed: Oct. 19, 2001

(65) Prior Publication Data

US 2003/0076204 A1 Apr. 24, 2003

(51) Int. Cl.[7] ..... H01H 11/09; H01H 13/04
(52) U.S. Cl. ..... 335/202; 439/723
(58) Field of Search ..... 439/723–724; 335/202

(56) References Cited

U.S. PATENT DOCUMENTS

| | | | | | |
|---|---|---|---|---|---|
| 2,820,211 | A | * | 1/1958 | Batcheller | 439/723 |
| 2,909,757 | A | * | 10/1959 | Speck | 439/723 |
| 3,539,977 | A | * | 11/1970 | Woertz | 439/811 |
| 3,763,401 | A | * | 10/1973 | Ransom | 361/826 |
| 3,775,733 | A | * | 11/1973 | Ege | 439/724 |
| 3,879,100 | A | * | 4/1975 | Chabot | 439/487 |
| 4,603,376 | A | * | 7/1986 | Maier | 361/824 |
| 4,697,860 | A | | 10/1987 | Hildebrandt et al. | |
| 5,107,396 | A | * | 4/1992 | Rosen et al. | 361/637 |
| 5,117,211 | A | * | 5/1992 | Morgan et al. | 335/202 |
| 5,150,091 | A | | 9/1992 | Hart et al. | |
| 5,304,761 | A | | 4/1994 | Rosen et al. | |
| 5,488,337 | A | | 1/1996 | Hubbard et al. | |
| 5,718,610 | A | * | 2/1998 | Faber | 439/797 |
| 5,831,498 | A | | 11/1998 | Maloney et al. | |
| 6,144,001 | A | | 11/2000 | Green et al. | |
| 6,172,586 | B1 | | 1/2001 | Ferree et al. | |

FOREIGN PATENT DOCUMENTS

| | | | |
|---|---|---|---|
| JP | 02126529 | A | 5/1990 |

* cited by examiner

*Primary Examiner*—Lincoln Donovan
*Assistant Examiner*—Bernard Rojas
(74) *Attorney, Agent, or Firm*—Martin J. Moran

(57) ABSTRACT

A removable quick connect terminal for an electric power switch has a molded housing with an open cavity and an electrically conductive terminal member with a plurality of male terminations that project through slots in a cavity wall in the housing into the open cavity. The terminal member has a tang projecting outward from the housing that is clamped by a conventional collar terminal to a power conductor of the switch projecting into an external terminal recess in the molded switch casing. The terminal member is secured to the molded housing by a pair of oppositely facing chamfered catches engaging an opening in the flat center section of the terminal member. The molded housing of the quick connect terminal has hooks which engage abutment surfaces on the switch casing and a pair of integral compliant latches which engage latch ledges in the external terminal recess to removably secure the housing to the switch casing.

9 Claims, 2 Drawing Sheets

QUICK CONNECT TERMINAL FOR ELECTRIC POWER SWITCH

BACKGROUND OF THE INVENTION

1. Field of the Invention

This invention relates to electric power switches and to terminals for connecting such switches to electrical conductors, especially terminals for making quick connections, including connections to multiple wires, without the need for tools.

2. Background Information

Power switches used in electrical distribution systems, such as for instance, circuit breakers, transfer switches, disconnect switches, contacts, motor starters and the like, require connections for electrically connecting the power conductors of the switch to the electrical conductors of the distribution system. Typically, the power conductor of the switch is a rigid, flat conductor. A common connection for cable connected switches, that is switches connected to electrical cables or wires, is the collar terminal. The collar terminal has a cylindrical or square body with a transverse slot in which the flat power conductor of the switch and wire or cable are received, and a tapped bore into which a screw is threaded to clamp the wire or cable against the power conductor while also securing the collar to the power conductor. Typically, the collar terminal is received in a recess in a molded casing of the power switch.

In some applications, it is desirable to have a quick connection for connecting the wires or cables to the power conductors of the switch, preferably without the need of a tool such as a screwdriver, as is required for the collar terminal. In other applications, it is desirable to be able to easily connect multiple wires to the same power conductor, preferably without having to clamp multiple wires with a single collar connector.

Circuit breakers are available with quick connect terminals. The usual collar terminal is replaced by a terminal fabricated from sheet material having a number of male connectors projecting from edges of one face, and a common tang projecting from an edge of the opposite face and brazed or welded to the power conductor of the circuit breaker. Female clips on wires then slide onto the male connectors to provide multiple quick connections. However, the purchaser must specify the type of terminals wanted: either collar type or quick connect type. They are not interchangeable. Thus, the manufacturer must make and stock switches with each type of terminal connector and the purchaser must elect the switch with the desired terminals.

There is room for improvement, therefore, in terminals for electric power switches.

SUMMARY OF THE INVENTION

The invention provides an improved quick connect terminal for an electric power switch having a molded casing with a power conductor extending into an external terminal recess in the molded casing and a terminal connector connected to the power conductor in the terminal recess. The quick connect terminal comprises a molded housing having an open cavity and a mount removably mounting the molded housing to the molded casing of the power switch at the external recess. An electrically conductive terminal member has one end releasably secured to the power conductor by the terminal connector, and at a second end, at least one male termination terminating in the open cavity. The housing of the quick connect terminal has a cavity wall with a slot through which the at least one male termination extends into the open cavity. The terminal member can have a plurality of the male terminations, in which case the cavity wall has a plurality of slots so that the plurality of male terminations all extend into the open cavity. In the exemplary embodiment of the invention there are four male terminations in the open cavity.

The terminal member is a flat electrically conductive strip having a center section with the first end bent to form a tang extending transversely from one end of the center section in a first direction. The one or more male terminations extend transversely from the center section in a second direction opposite the first direction. These male terminations can extend from opposite side edges of the center section.

The molded housing of the quick connect terminal can have a retainer securing the terminal member to the molded housing. This retainer can be in the form of an opening in the center section of the terminal member and a pair of oppositely facing catches, preferably in the form of hooks molded on the cavity wall which flex to engage opposite edges of the opening in the terminal member. These hooks can be chamfered so that they deflect to engage the opening as the center section of the terminal member is pressed against the chamfered hooks.

The mount mounting the molded housing of the quick connect terminal to the molded casing of the power switch can include at least one compliant latch on the molded housing which engages a latch ledge molded into the external recess of the switch molded housing. In this regard, the external recess in the molded housing of the power switch can have an elongated opening and inwardly facing latch ledges on each side. In this case, the mount includes a pair of spaced apart compliant latches on the molded housing of the quick disconnect terminal having opposite facing latch hooks which engage the latch ledges. This pair of compliant latches can be cantilevered from and integrally molded with the molded housing. They can have opposite facing finger grips by which the pair of compliant latches are squeezed toward each other to release the molded housing from engagement with the molded casing of the power switch. The mount can further include a pair of compliant latches cantilevered from one end of the molded housing and at least one mounting hook extending adjacent the second end of the mold housing and engaging an abutment surface on the molded casing.

The invention also embraces an electric power switch which comprises a molded casing having an external recess, a power conductor projecting into the terminal recess and a collar terminal received in the terminal recess and having a terminal body with a transverse slot into which the power conductor extends. The terminal body also has a tapped longitudinal bore and a terminal screw threaded into the tapped longitudinal bore that clamps against the power conductor. The electric power switch further includes a quick connect terminal comprising an electrically conductive terminal member having a tang at one end and at least one male terminal adjacent a second end. The quick connect terminal further includes a molded housing having an open cavity into which the at least one male terminal projects with the tang projecting from the housing. The tang is removably received in the collar terminal and clamped against the power conductor by a terminal screw. The molded housing of the quick connect terminal can include a mount for removably securing the molded housing to the molded casing at the external terminal recess. This mount can include one or more compliant latches which engage latch ledges in the external recess of the power switch molded casing. In a particularly advantageous arrangement, a pair of compliant latches are cantilevered from one end of the molded housing and can be provided with finger grips for squeezing the compliant latches together to release them from the latch ledges in the recess in the power switch molded casing. In addition, the molded casing can have at least one mounting hook extending adjacent the opposite end of the molded housing and engaging an abutment surface on the molded casing of the power switch.

With the above arrangements, a single power switch can be provided either with a conventional terminal or a quick connect terminal. Hence, only one power switch need be stocked, and it can be provided by the manufacturer or can be field adapted to have either type of terminal connector.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
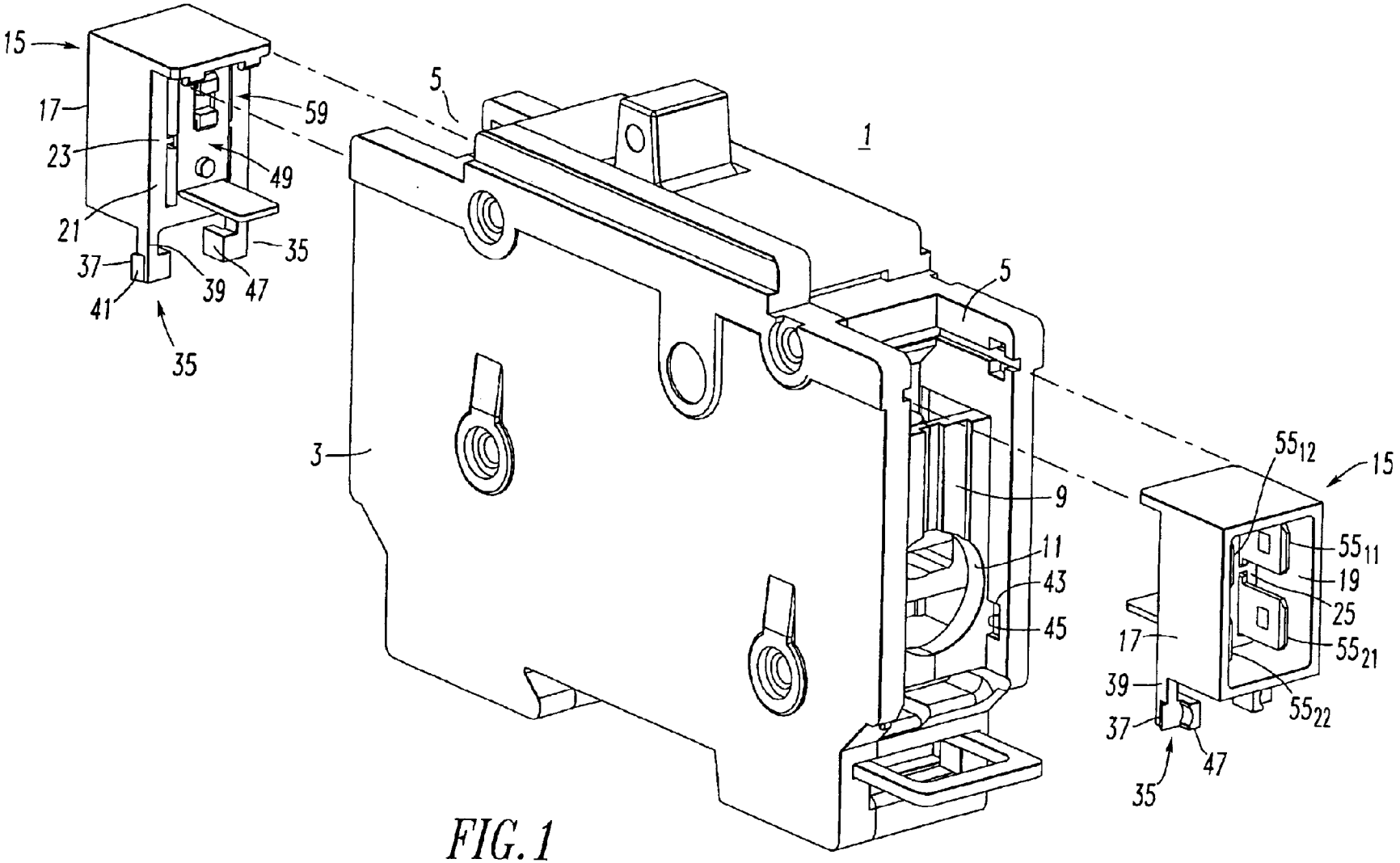
FIG. 1 is an exploded isometric view of a circuit breaker with two quick connect terminals aligned for mounting on the circuit breaker.
Figure 3:
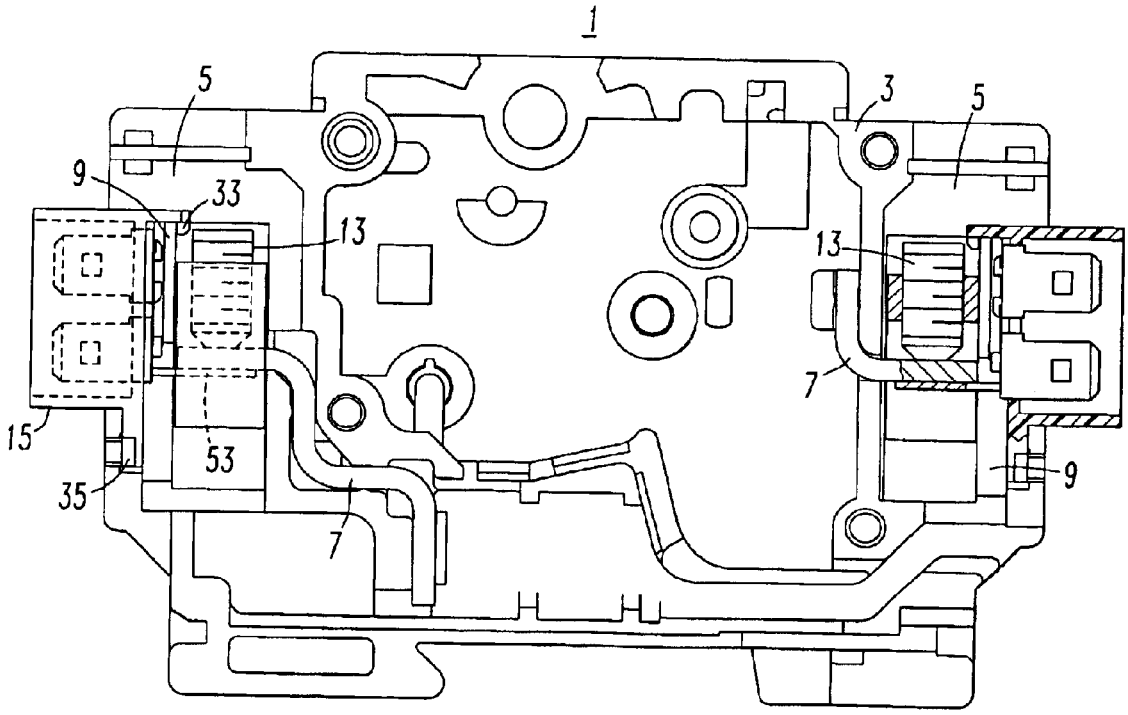
FIG. 3 is a cross-sectional view through a circuit breaker equipped with quick connect terminals, one of which is shown in section.

The quick connect terminal of the invention will be described as applied to a miniature circuit breaker. However, it will be evident that this quick connect terminal can be used with other electric power switches. Referring to FIGS. 1 and 3, the circuit breaker 1 has a molded casing 3 which forms at each end an external terminal recess 5. The main conductors 7 of the circuit breaker extend into and terminate in these external terminal recesses 5. The external terminal recess 5 has a front wall 9 with an opening 11 through which a cable (not shown) can be inserted for connection to the main conductor 7 such as by a collar terminal 13, as is well known.

As mentioned, in some applications it is desirable to have a quick connection for connecting wires or cables to the main conductors of the circuit breaker 1, preferably without the need of a tool, as is required for the collar terminal 13. The quick connect terminal 15 provides this capability. The quick connect terminal 15 includes a molded housing 17 defining an open cavity 19. A rear cavity wall 21 with a first outer face 23 and a second inner face 25 face the open cavity 19. A plurality of slots 27 extend through the rear cavity wall 21 from the first face 23 to the second face 25. In the exemplary quick connect terminal 15 there are four such slots 27.

The molded housing 17 of the quick connect terminal 15 is secured to the circuit breaker 1 by a mount 29. The mount 29 includes mounting lips 31 projecting downward from an extension of the top wall 33 of the molded housing 17. The mount 29 further includes a pair of spaced apart compliant latches 35 having outwardly oppositely facing latch hooks 37 cantilevered from the bottom of the housing 17 on latch legs 39. The latch hooks 37 have chamfered front edges 41 which cam the latches inward until the hooks 37 snap into recesses 43 in the molded casing 3 of the circuit breaker 1 and engage the latch ledges 45. A pair of integrally molded finger grips 47 can be squeezed together to release the latches.

Figure 2:
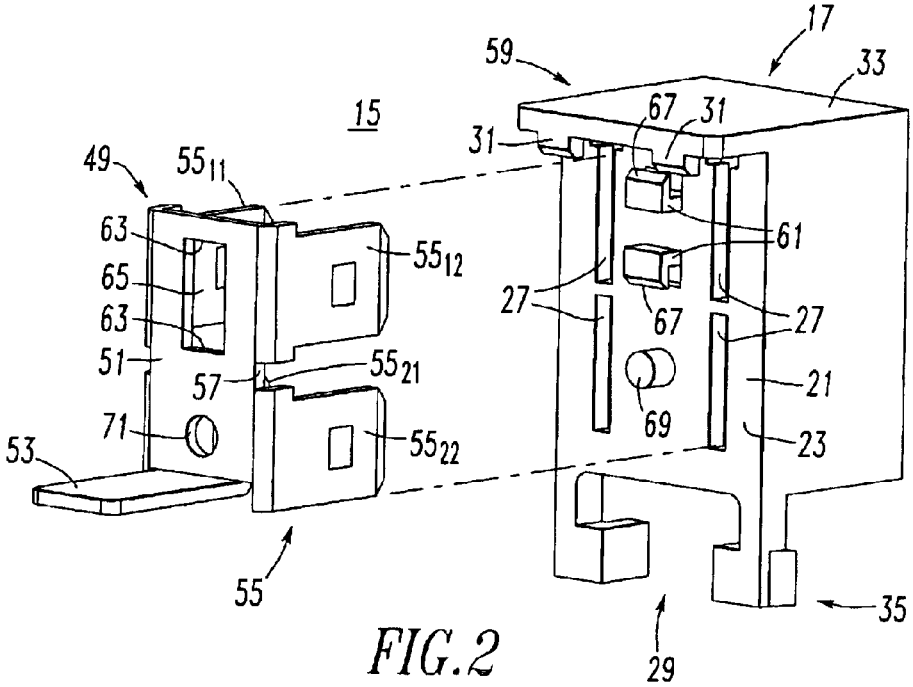
FIG. 2 is an exploded isometric view of the quick connect terminal of the invention showing details of the molded housing and the terminal member.

The quick connect terminal 15 also includes an electrically conductive terminal member 49. As best seen in FIG. 2, the terminal member 49 is formed of a flat strip having a center section 51 and a first end 53 bent to form a tang extending transversely from one end of the center section in a first direction. A plurality of spade terminations 55 extend like fingers from the side edges 57 of the center section 51. The exemplary terminal member 49 has four such spade terminations 55 which can be considered as two pair, which each pair 5511, 5512, and 5521 and 5522 including one spade termination on each side edge 57 of the center section 51 and with the respective spade terminations of the two pair of spade terminations spaced along the side edges.

When the quick connect terminal 15 is assembled, the center section 51 of the terminal member 49 extends along the first face 23 of the rear cavity wall 21 of the molded housing 17 with the spade terminations 55 extending through the slots 27 and terminating in the open cavity 19. A retainer 59 secures the terminal member 49 to the molded housing 17. This retainer 59 is formed by a pair of oppositely facing catches 61 molded on the first face 23 of the rear cavity wall 21 which engage opposite edges 63 of a rectangular opening 65 in the center section 51 of the terminal member 49. The catches 61 are chamfered at 67 so that the terminal member can be pressed into place. A molded pin 69 on the first face 23 of the rear cavity wall 21 engages an aperture 71 in the center section 51 of the terminal member 49 to fix the relative position of the terminal member 49 on the molded housing 17.

When it is desired to provide a quick connect for the circuit breaker 1, the mounting lip 31 on the molded housing 17 is hooked over an abutment surface formed by the top edge 73 of the front wall 9 on the molded casing 3 as shown in FIG. 3. The molded housing 17 is then rotated downward so that the tang formed by the first end 53 of the terminal member 49 passes through the opening 11 in the front wall 9 of the casing 3 and slides into the collar terminal 13. As the molded housing 17 is further rotated until it is flat against the end of the molded casing 3 of the circuit breaker, the latches 35 are deflected inward by the side edges of the recess 5 until they snap into the latch recesses 43 to securely attach the housing 17 to the circuit breaker 1. The collar terminal 13 is then tightened to clamp the tang 53 against the main conductor 7 thereby connecting the spade terminations 55 to the main conductor of the circuit breaker. Whenever it is desired to remove the quick connect terminal, the collar terminal is unscrewed to release the tang 53. Then, the finger grips 47 are squeezed together to release the latches 35 from the latch recesses 53 so that the housing 17 can be rotated upward to extract the tang from the opening 11 and unhook the mounting lip 31 from the top of the front wall 9 of the circuit breaker molded casing. Thus, it can be appreciated that the circuit breaker can be quickly and easily converted between the conventional collar terminal and a quick connect terminal.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A quick connect terminal for an electric power switch having a molded casing with a main conductor extending into an external terminal recess in the molded casing and a terminal connector connected to the main conductor in the terminal recess, said quick connect terminal comprising:

a molded housing having an open cavity and a mount removably mounting the molded housing to the molded casing at the external terminal recess;

an electrically conductive terminal member having a tang releasably secured to the main conductor by the terminal connector and at least one spade termination terminating in the open cavity; and wherein the terminal member is a flat strip having a center section with the tang bent to extend transversely from one end of the center section in a first direction and with the at least one spade termination extending transversely from the center section in a second direction opposite the first direction.

2. The quick connect terminal of claim 1 wherein the terminal member has a plurality of spade terminations extending transversely in the second direction from edges of the center section.

3. The quick connect terminal of claim 1 wherein the terminal member has two pair of spade terminations with each pair of spade terminations including one spade termination on each side edge and with respective spade terminations of the two pair of spade terminations spaced along the side edges.

4. The quick connect terminal of claim 2 wherein the cavity wall has a first face facing the external terminal recess in the molded casing and a second face facing the open cavity and a plurality of slots extending there through, the center section of the terminal member extending along the first face of the cavity wall with the plurality of spade terminations projecting through the plurality of slots in the cavity wall into the open cavity.

5. The quick connect terminal of claim 1 wherein the molded housing includes a retainer securing the terminal member to the molded housing.

6. The quick connect terminal of claim 5 wherein the retainer comprises an opening in the center section of the terminal member and a pair of oppositely facing catches molded on the first face of the cavity wall and which flex to engage opposite edges of the opening.

7. The quick connect terminal of claim 6 wherein the catches are chamfered to deflect for engagement with the opening as the center section of the terminal member is pressed against the catches.

8. A quick connect terminal for an electric power switch having a molded casing with a main conductor extending into an external terminal recess in the molded casing and a terminal connector connected to the main conductor in the terminal recess, said quick connect terminal comprising:

a molded housing having an open cavity and a mount removably mounting the molded housing to the molded casing at the external terminal recess;

an electrically conductive terminal member having a tang releasably secured to the main conductor by the terminal connector and at least one spade termination terminating in the open cavity;

wherein the external terminal recess in the molded casing has inwardly facing latch ledges on each side and the mount includes a pair of spaced apart compliant latches having oppositely facing latch hooks which engage the latch ledges; and wherein the pair of compliant latches are cantilevered from and integrally molded with the molded housing and have oppositely facing finger grips by which the pair of compliant latches are squeezed toward each other to release the molded housing from engagement with the molded casing.

9. The quick connect terminal of claim 8 wherein the pair of compliant latches are cantilevered from one end of the molded housing and the mounting further includes at least one mounting hook extending adjacent the second end of the molded housing and engaging an abutment surface on the molded casing.

* * * * *